US007832066B2

(12) United States Patent
Ehler

(10) Patent No.: US 7,832,066 B2
(45) Date of Patent: Nov. 16, 2010

(54) RETRACTABLY EXTENDABLE FASTENER SYSTEM

(76) Inventor: Bradley D. Ehler, 7411Black Elk Trail, Laramie, WY (US) 82070

( * ) Notice: Subject to any disclaimer, the term of this patent is extended or adjusted under 35 U.S.C. 154(b) by 523 days.

(21) Appl. No.: 11/999,062

(22) Filed: Dec. 4, 2007

(65) Prior Publication Data

US 2008/0127462 A1 Jun. 5, 2008

Related U.S. Application Data

(60) Provisional application No. 60/872,646, filed on Dec. 4, 2006.

(51) Int. Cl.
*A44B 9/00* (2006.01)

(52) U.S. Cl. ..... 24/707.7; 24/710.4; 24/710.5

(58) Field of Classification Search ..... None
See application file for complete search history.

(56) References Cited

U.S. PATENT DOCUMENTS

| | | | | |
|---|---|---|---|---|
| 231,049 | A * | 8/1880 | Inskeep | 132/282 |
| 490,435 | A | 1/1893 | Hall | |
| 523,547 | A | 7/1894 | Ridgway, Jr. | |
| 2,644,211 | A * | 7/1953 | Sumner | 24/707.7 |
| 3,531,833 | A | 10/1970 | Bignert | |
| 3,909,884 | A | 10/1975 | Weckesser | |
| 4,520,536 | A | 6/1985 | Hata | |
| 5,662,513 | A | 9/1997 | Cuhel | |
| 5,940,942 | A | 8/1999 | Fong | |
| 6,012,203 | A | 1/2000 | Pearson | |
| 6,056,624 | A | 5/2000 | Fildan | |
| 6,295,703 | B1 | 10/2001 | Adams et al. | |
| 6,321,422 | B1 | 11/2001 | Fildan et al. | |
| 6,718,600 | B1 | 4/2004 | Gillis | |
| 2006/0236509 | A1 | 10/2006 | Ausman | |
| 2008/0054129 | A1 * | 3/2008 | Lobl et al. | 248/95 |

FOREIGN PATENT DOCUMENTS

| | | |
|---|---|---|
| GB | 926932 | 5/1963 |

* cited by examiner

*Primary Examiner*—Jack W. Lavinder
(74) *Attorney, Agent, or Firm*—Craig R. Miles; CR Miles, P.C.

(57) ABSTRACT

A fastener which operates to provide retractably extendable fastener elements which allow for attachment and detachment of the fastener to fastenable materials.

14 Claims, 8 Drawing Sheets

RETRACTABLY EXTENDABLE FASTENER SYSTEM

This United States Non-provisional Patent Application claims the benefit of U.S. Provisional Patent Application No. 60/872,646, filed Dec. 4, 2006, hereby incorporated by reference.

I. BACKGROUND

A fastener which operates to provide retractably extendable fastener elements which allow for attachment and detachment of the fastener to fastenable materials.

There are numerous and varied conventional fasteners which fasten by mated engagement of mechanical parts such as a hook into an eyelet or a hook into a loop. Typically, objects to be fastened provide a first surface and a second surface each of which provide a corresponding mateable part of a fastener having a fixed configuration which mate to dispose the first surface and the second surfaced in mated relation.

Accordingly, a first problem with conventional fasteners may be the necessity to provide two mateable parts each of which mount to a corresponding one of a pair of object surfaces to achieve mated relation of the object surfaces upon operation of the conventional fastener.

A second problem with conventional fasteners may be that the lesser or greater size of the objects to be disposed in mated relation require a corresponding plurality of mateable parts having greater or lesser size because the mated parts of a conventional fastener do not dynamically adjust to the greater or lesser size of the objects to be disposed in mated relation.

A third problem with conventional fasteners may be that the matable parts of a fastener are not extendably retractable within a housing. Accordingly, conventional mateable parts of fasteners can become fastened to each other or non-specifically fasten to surfaces in an undesired manner.

Embodiments of the inventive fastener described below can provide a practical solution to each of the above-identified problems.

II. SUMMARY OF THE INVENTION

Accordingly, a broad object of the invention can be to provide fastener which operates to provide retractably extendable fastener elements which allow for attachment and detachment of the fastener to fastenable materials.

A second broad object of the invention can be to provide a fastener which can be removably engaged with various fastable materials without first attaching a matable part to the fastenable material.

A third broad object of the invention can be to provide a fastener having extendably retractable fastener hooks which adjust to fasten to numerous and varied fastenable materials without having to provide a corresponding numerous and varied configurations of mechanical parts.

A fourth broad object of the invention can be to provide a fastener having a housing from which a plurality of fastener hooks can extendably retract.

Naturally, further objects of the invention are disclosed throughout other areas of the specification, drawings, photographs, and claims.

III. A BRIEF DESCRIPTION OF THE DRAWINGS

IV. DETAILED DESCRIPTION OF THE PREFERRED EMBODIMENTS

A fastener which operates to provide retractably extendable fastener elements which allow for attachment and detachment of the fastener to fastenable materials.

Figure 1:
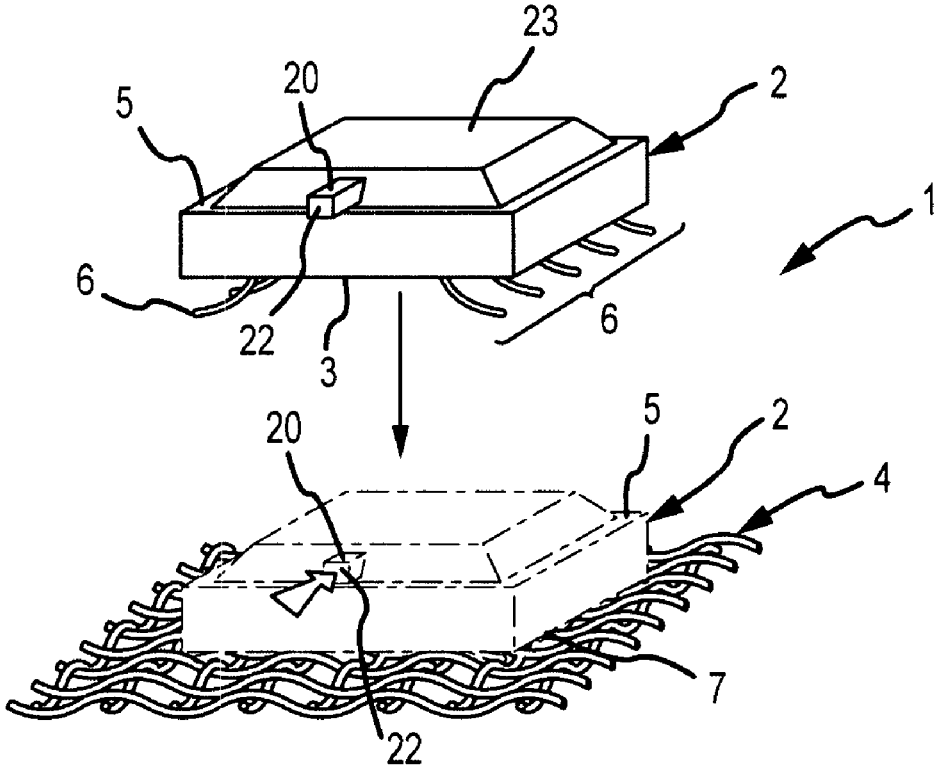
FIG. 1 shows a particular embodiment of the inventive fastener capable of engagement to a fastenable material.
Figure 2:
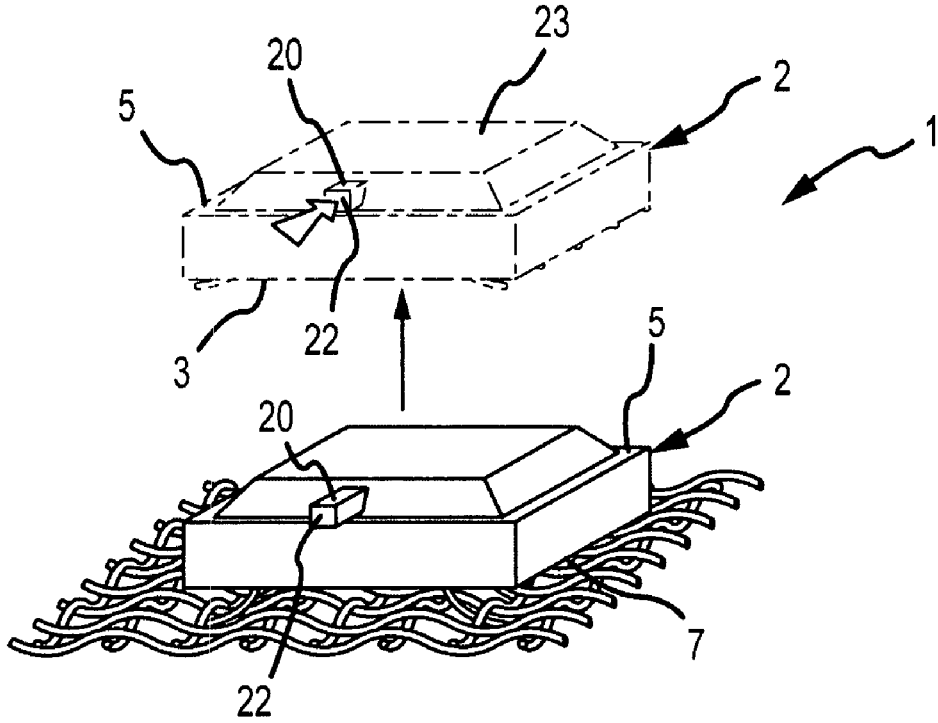
FIG. 2 shows a particular embodiment of the inventive fastener capable of disengagement from a fastenable material.

Now referring primarily to FIGS. 1 and 2, generally embodiments of the inventive fastener (1) can include a fastener body (2) having a first external surface (3) configured to removably engage a fastenable material (4) and a second external surface (5) disposed in generally opposed relation a distance apart. As to the various embodiments of the fastener body (2), each can be fabricated, machined, molded, injection molded from numerous and varied plastics, metals, or the like.

The fastenable material (4) can include numerous and varied materials having a constructional form which allows at least one fastener hook (6) (further described below and show in the various figures) to fasten to a part of the material (7). As shown in FIGS. 1 and 2, a non-limiting example of a fastenable material (4) can include a plurality of individual elongate fibers wovenly engaged in a manner which allows at least one fastener hook (6) sufficient ingress to the woven engagement of individual elongate fibers to fasten to a part of the material (7), such as one or more of the individual elongate fibers. As a second non-limiting example, the fastenable material (7) can be molded or pressed to provide a pattern of fibers which define apertures in the material through which at least one fastener hook (6) can sufficient ingress to fasten to a part of the fastenable material (7). The first external surface (3) of the fastener body (2) can be configured in numerous and various forms which allow removable engagement with the fastenable material (4). Removable engagement as used herein means that the first external surface (3) has a configuration which can sufficiently engage the fastenable material (4) to allow the fastener hook (6) to fasten and unfasten by normal operation of the fastener (1) to the fastenable material (4).

Now referring primarily to FIG. 1, a particular method of fastening the fastener (1) can include generating travel in a fastener element retractor (15) (further described below and shown in FIGS. 3-9 and 13-14) by operation of a fastener element retractor travel generator (20) from a first fastener element retractor position (16) toward a second fastener element retractor position (17) to retract the fastener hooks (6) toward or within the fastener body (2). The fastenable material (4) can then be engaged with the first external surface (3) of the fastener body (2) (as shown in FIG. 1 by an embodiment of the fastener (1) shown in broken object lines). Once the first external surface (3) of the fastener body (2) has engaged the fastenable material (4), generating travel in the fastener element retractor (15) from the second fastener element retractor position (17) toward the first fastener element retractor position (16) extends the fastener hooks (6) to fasten the inventive fastener (1) to the fastenable material (4).

Now referring primarily to FIG. 2, a particular method of unfastening the fastener (1) can include generating travel in the fastener element retractor (15) (further described below and shown in FIGS. 3-9 and 13-14) by operation of a fastener element retractor travel generator (20) from the first fastener element retractor position (16) toward the second fastener element retractor position (17) to retract the fastener hooks (6) toward or within the fastener body (2). The fastenable material (4) can then be disengaged with the first external surface (3) of the fastener body (2) (as shown in FIG. 2 by an embodiment of the fastener (1) shown in broken object lines). Once the first external surface (3) of the fastener body (2) has disengaged the fastenable material (4), generating travel in the fastener element retractor (15) from the second fastener element retractor position (17) toward the first fastener element retractor position (16) extends the fastener hooks (6). The operation can be repeated as desired.

Now referring generally to FIGS. 3-17, non-limiting embodiments the inventive fastener (1) can provide a first external surface (3) of the fastener body (2) of generally planar or flat configuration. Typically, the fastenable material (4) has sufficient flexibility to alter surface configuration sufficiently to allow a first external surface (3) of generally planar configuration to be engaged and removed from the surface of the fastenable material (4). Understandably, if the fastenable material (4) has a fixed or rigid form or is supported by a material which induces a fixed or rigid form upon the fastenable material (4) which cannot be engaged by a first external surface (3) of generally planar or flat configuration, the first external surface (3) can be configured differently to removably engage the fastenable material (4) (or as to certain embodiments include a level of flexure sufficient to allow removable engagement). The first external surface (3) can define an area of numerous and varied geometries and while the examples of the inventive fastener (1) shown in the figures are of generally square, rectangular or circular geometry the area defined by the first external surface (3) is not so limited.

Again referring generally to FIGS. 3-17, the second external surface (5) of the fastener body (2) can be disposed in generally opposed relation to the first external surface (3) a distance apart. The second external surface (5) can be of any constructional form and disposed at any distance from the first external surface (5) which further allows the plurality of fastener member pathways (8) to communicate between the first external surface (3) and the second external surface (5) of said fastener body (2). As to particular embodiments of inventive fastener (1) as shown in the figures, each of the plurality of fastener member pathways (8) can provide a generally linear pathway circular in cross section communicating between the first external surface (3) and the second external surface (5) of the fastener body (2) at an angle. However, it is not intended that embodiments of the inventive fastener (1) be limited to a plurality of fastener member pathways of any particular number, degree of linearity, cross section configuration, angle between the first external surface (3) and the second external surface (5), or the like.

Rather, the plurality of fastener member pathways (8) can each be of any construction form or configuration depending on the application which allows slideable engagement of a resiliently flexible fastener member (10) of a corresponding one of the plurality of fastener elements (9). Typically, the resiliently flexible fastener member (10) will provide a circular geometry in cross section with a cross sectional area which slidely engages within a corresponding one of the plurality of fastener member pathways (8) having generally linear pathway circular in cross section which communicates between the first external surface (3) and the second external surface (5) (see for example FIGS. 3 and 6).

The fastener hook (6) can be joined to the resiliently flexible fastener member (10). The manner in which the fastener hook (6) joins the resiliently flexible member can include fabrication of the resiliently flexible fastener member (10) and the fastener hook (6) as separate pieces joined in a subsequent step or by fabrication as a single integral continuous piece. Slideable engagement of the resiliently flexible fastener member (10) in a corresponding one of the plurality of fastener member pathways (8) adjusts location of the fastener hook (6) in relation to the first external surface (3) of the fastener (1). As to certain embodiments of the fastener (1), slidable engagement of the resilient flexible member (10) in a corresponding one of the plurality of fastener member pathways (8) allows retraction of the fastener hook (6) to locate inside a part of one of the plurality of fastener member pathways (8) (where the fastener hook (6) has sufficient resilient flexure to operate between a generally linear configuration inside the corresponding one of the plurality of fastener member pathways (8) and an arcuate configuration outside of the corresponding one of the plurality of fastener member pathways (8)) or within a fastener hook recess (11) (see for example FIG. 3).

The fastener hook (6) typically defines a configuration or constructional form capable of removable engagement to a part of a particular fastenable material (4). Typically, the configuration of a fastener hook (6) includes an arcuate element (12) (or assumes an arcuate element when extended by slideable engagement of the resilient flexible fastener member (10) to locate outside of the corresponding one of the plurality of fastener member pathways (8)) which functions to provide hooked engagement with one or a plurality of elongate fibers of the fastenable material (4). However, the configuration of the fastener hook (6) is not so limited and the fastener hook 16) can provide any of a numerous and varied configurations which can sufficiently engage the fastenable material (4) to fix the location of the fastener hook (6) (whether with or without further slideable engagement of the resiliently flexible member (10) in a corresponding one of the plurality of fastener member pathways (8)). Accordingly, the fastener hook (6) can include an arcuate element (12) of greater or lesser curvature, a plurality of arcuate elements of greater or lesser curvature, a flattened terminal portion which extends outwardly from the longitudinal axis of the resiliently flexible fastener member (10), or the like.

Figure 8:
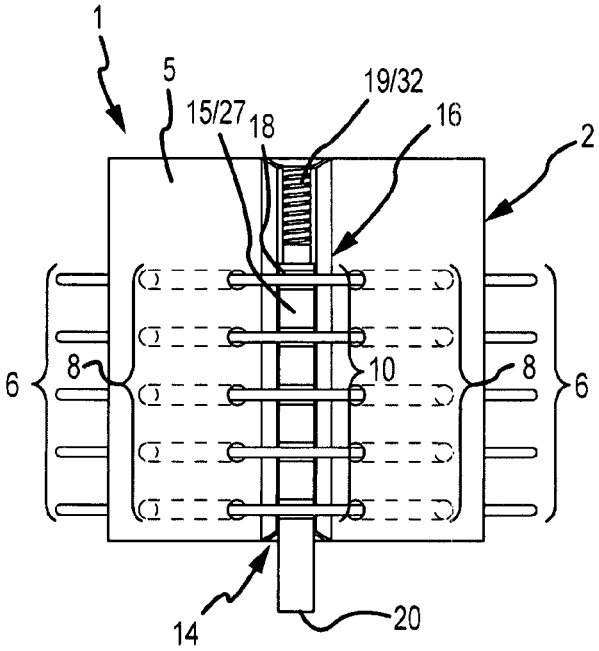
FIG. 8 is a top view of a particular embodiment of the inventive fastener with the fastener cover detached with the fastener element retractor located in the first fastener element retractor position.
Figure 9:
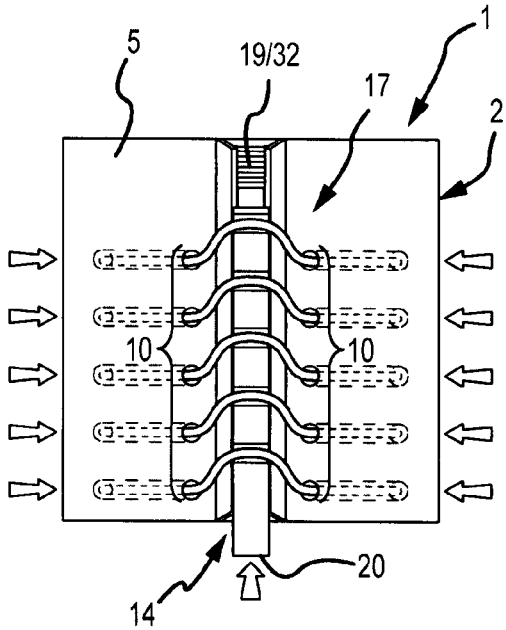
FIG. 9 is a top view of a particular embodiment of the inventive fastener with the fastener cover detached with the fastener element retractor located in the second fastener element retractor position which establishes each resiliently flexible member in a flexed condition.
Figure 6:
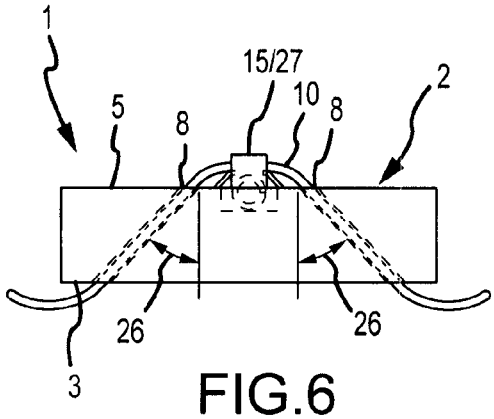
FIG. 6 is an end view of a particular embodiment of the inventive fastener with the fastener cover detached.
Figure 7:
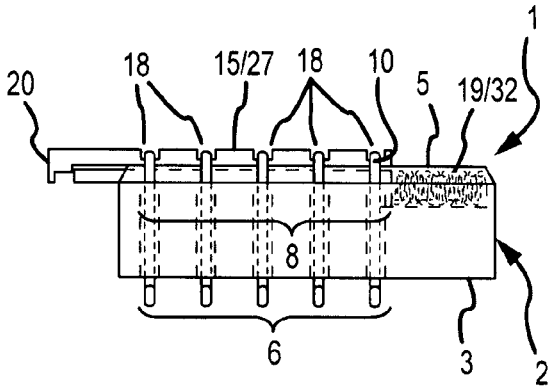
FIG. 7 is a side view of a particular embodiment of the inventive fastener with the fastener cover detached.
Figure 12:
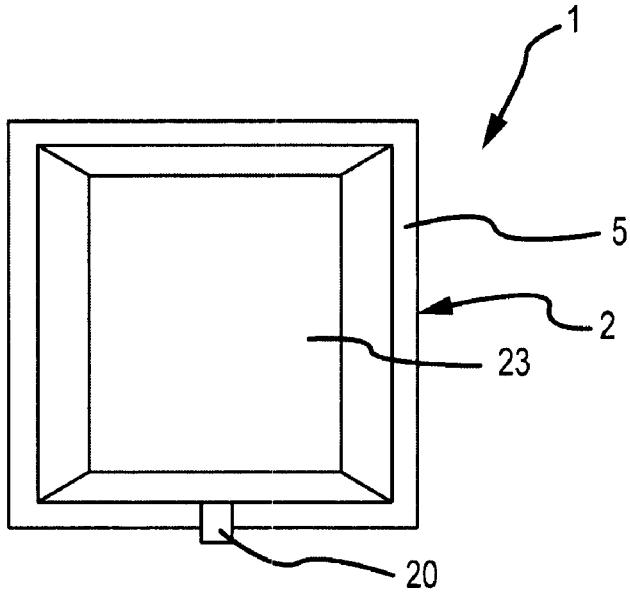
FIG. 12 is a top view of a particular embodiment of the inventive fastener with the fastener cover attached.
Figure 10:
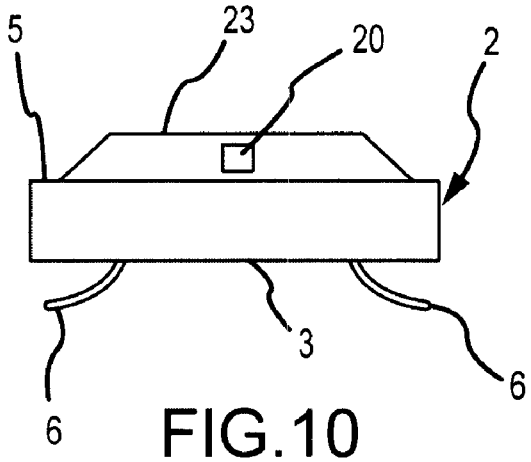
FIG. 10 is an end view of a particular embodiment of the inventive fastener with the fastener cover attached.
Figure 11:
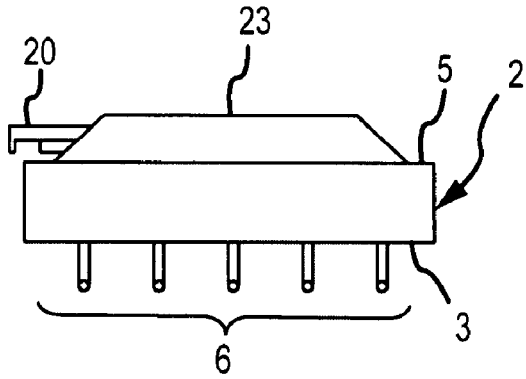
FIG. 11 is a side view of a particular embodiment of the inventive fastener with the fastener cover attached.
Figure 13:
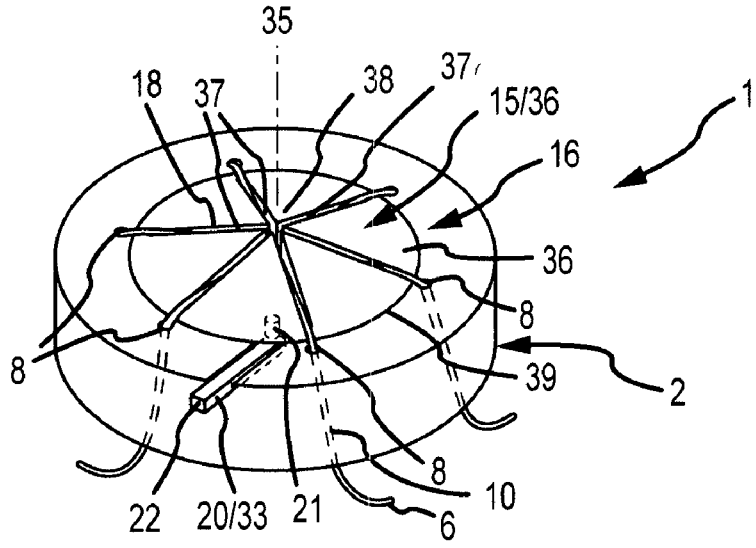
FIG. 13 is a perspective view of a particular embodiment of the inventive fastener with the fastener cover detached with the fastener element retractor located in the first fastener element retractor position.
Figure 14:
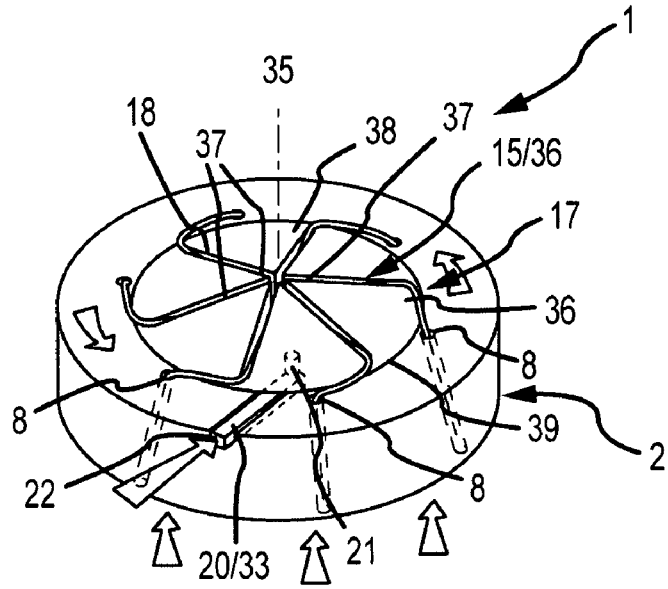
FIG. 14 is a perspective view of a particular embodiment of the inventive fastener with the fastener cover detached with the fastener element retractor located in the second fastener element retractor position which establishes each resiliently flexible member in a flexed condition.
Figure 15:
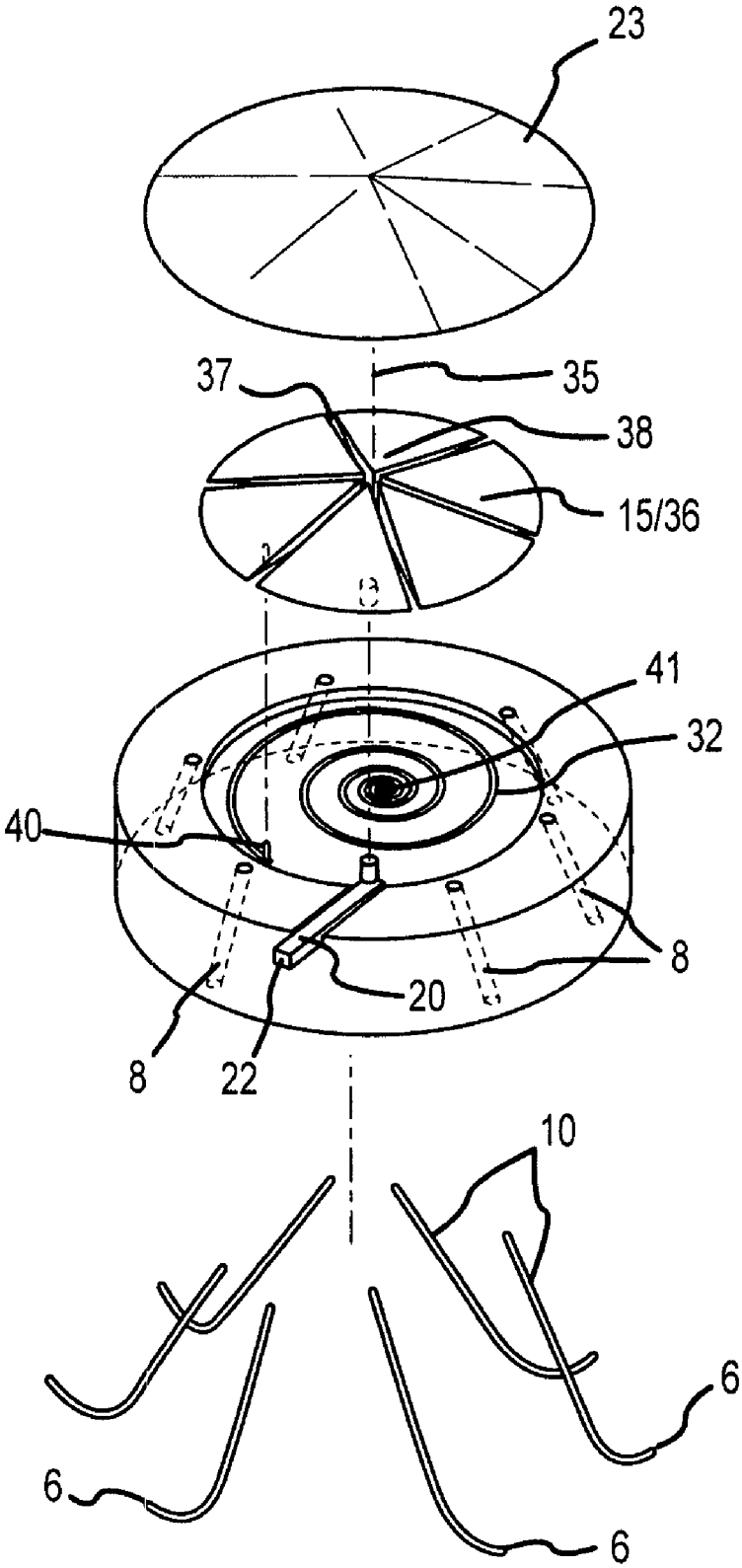
FIG. 15 is a perspective view of a particular embodiment of the inventive fastener with the fastener cover attached.
Figure 18:
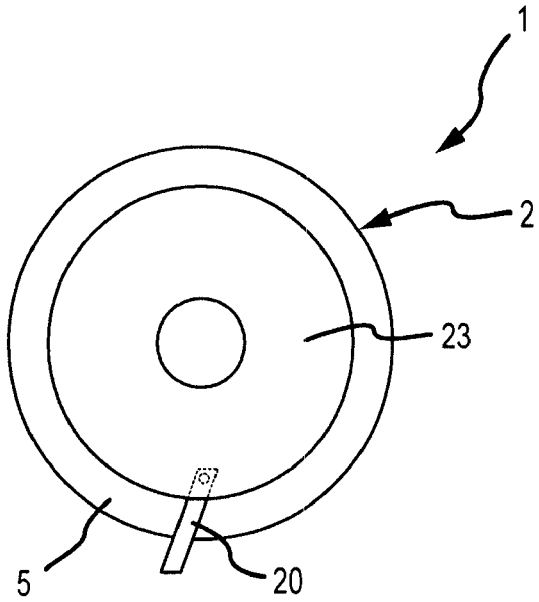
FIG. 18 is a top view of a particular embodiment of the inventive fastener with the fastener cover attached.
Figure 16:
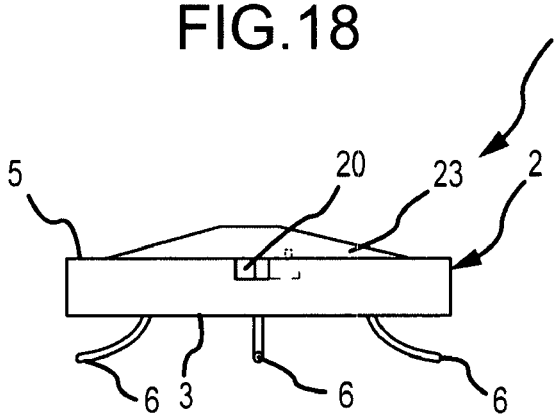
FIG. 16 is a end view of a particular embodiment of the inventive fastener with the fastener cover attached.
Figure 17:
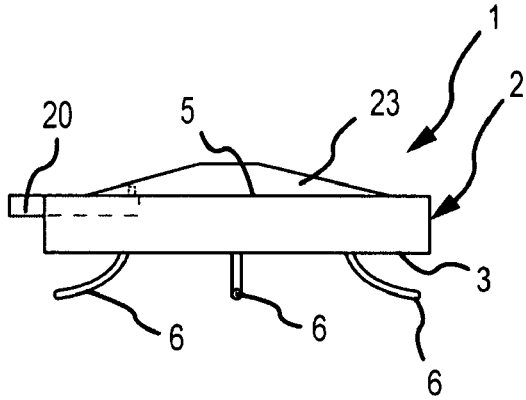
FIG. 17 is a side view of a particular embodiment of the inventive fastener with the fastener cover attached.

Now referring primarily to FIGS. 3-9 and 13-14 the inventive fastener (1) can further include a fastener element retractor assembly (14) (see for example FIG. 3 encompassed by the broken lines) operably coupled to the fastener body (2) to allow travel of a fastener element retractor (15) between a first fastener element retractor position (16) (see as examples FIGS. 8 and 13) and a second fastener element retractor position (17) (see as examples FIGS. 9 and 14). The fastener element retractor (15) can further provide a plurality of fastener element retainers (18) each of which correspondingly receive a resiliently flexible fastener member end (13) (see for example FIGS. 5 and 13). Each of the plurality of fastener element retainers (18) has a configuration which upon travel of the fastener element retractor (15) from the first fastener element retractor position (16) toward the second fastener element retractor position (17) deformably alters location of the resiliently flexible fastener member end (13) (see for example FIGS. 9 and 14) which results in slideable engagement of the corresponding resiliently flexible fastener member (10) in the corresponding one of the plurality of fastener member pathways (8) to adjust location of the joined fastener hook (6).

Deformable alteration of location of the resiliently flexible fastener member end (13) can store sufficient energy in the deformed resiliently flexible fastener member end (13) to forcible urge the fastener element retractor (15) from the second fastener element retractor position (17) toward the first fastener element retractor position (16). Alternately, embodiments of the inventive fastener (1) can further include a fastener element retractor return element (19) coupled between the fastener body (2) and the fastener element retractor (15) which forcibly urges said fastener element retractor (15) from said second fastener element retractor position (17) toward said first fastener element retractor position (16) (see for example the spring element (32) in FIG. 3).

Now referring generally to FIGS. 1-17, embodiments of the inventive fastener (1) can further include a fastener element retractor travel generator (20) slidely mated with the fastener body (2) which provides a first travel generator end (21) coupled to the fastener element retractor (15) and a second travel generator end (22) which extends a distance outwardly from the fastener body (2). Operation of the fastener element retractor travel generator (20) forcible urges the fastener element retractor (15) to travel from a first fastener element retractor position (16) toward the second fastener element retractor position (17) which deformably alters location of each resiliently flexible fastener member end (13) resulting in slideable engagement of the corresponding resiliently flexible fastener member in a corresponding one of the plurality of fastener member pathways (8) to adjust location of the joined fastener hook (6).

Now generally referring to FIGS. 1-3, 10-12, and 15-18, embodiments of the inventive fastener (1) can further include a fastener cover (23) which can be configured to join the fastener body (2) and enclose the fastener element retractor assembly (14). As to those embodiments of the inventive fastener which include the fastener element retractor generator (20) the fastener cover (23) an provide a fastener cover aperture (24) which allows the second travel generator end (22) to extend a distance outwardly from the fastener body (2), as above described. The external surface configuration of the fastener cover (23) joined to the fastener body (2) is not limited to any particular form.

Now referring in particular to FIGS. 1-12, which provide various views of an example of a non-limiting embodiment of the inventive fastener (1), it can be understood that the fastener body (2) can have a generally rectangular configuration which provides a substantially planar first external surface (3) which as above described can be removably engaged to a fastenable material (4). The second external surface (5) can be disposed in generally parallel planar opposed relation a distance apart defining a greater or lesser thickness of the fastener body (2) which can be for example between about one-sixteenth inch and about one quarter inch. The plurality of fastener member pathways (8) which communicate between the first external surface (3) and the second external surface (5) of the fastener body (2) can be disposed in a pair of substantially parallel rows (25) a distance apart which can be for example one quarter inch to about one half inch apart. Each one of the plurality of fastener member pathways (8) in each of the pair of parallel rows (25) can communicate between the first external surface (3) and the second external surface (5) of the fastener body (2) at a fastener member pathway angle (26) (typically between about thirty and about sixty degrees from perpendicular to the first external surface (3)) (see for example FIGS. 3 and 6) which assists in receiving each resiliently flexible fastener member end (13) of each resiliently flexible fastener member (10) into a corresponding one of the a plurality of fastener element retainers (18) of the fastener element retractor (15). As but one non-limiting example, each of the plurality of fastener elements (9) which slideably engage each of the corresponding plurality of fastener member pathways (8) can be generated from a length of spring temper wire having a diameter of a circular of between about 0.003 inch and about 0.126 inch depending on the embodiment of the fastener (1). The fastener element retractor (15) can be configured as a generally rectangular member (27) slideably mated in a generally rectangular channel (28) established in the fastener body (2) at a location between the pair of substantially parallel rows (25) of the plurality of fastener member pathways (8). The plurality of fastener element retainers (18) can comprise a plurality of slots (29) each disposed generally perpendicular to the longitudinal axis (30) of the generally rectangular member (27) of the fastener element retractor (15) each of which receive one resiliently flexible fastener member end (13) of a resiliently flexible fastener member (10) slidely engaged in a corresponding of the plurality of fastener member pathways (8). As shown for example in FIGS. 5, 8 and 9, as to certain embodiments of the inventive fastener (1), the opposed ends of a pair of resiliently flexible fastener member ends (13) can be received in one of the plurality of fastener element retainers (18). As to the specific embodiment of the inventive fastener (1) shown in FIGS. 5, 8 and 9 a pair of opposed ends of a pair of resiliently flexible fastener member ends (13) can be joined or produced as a single integral piece.

Now referring primarily to FIGS. 8 and 9, linear slidable operation of the generally rectangular member (27) in the generally rectangular channel (28) from the first fastener element retractor position (16) toward the second fastener element retractor position (17) can deformably alter location of the resiliently flexible fastener member end (13) (or generates a flexed resiliently flexible member end condition (30) of the resiliently flexible fastener member end (10)) which slides the resiliently flexible member (10) in each of the plurality of fastener member pathways (8) to adjust location of the fastener hook (6). The flexed resiliently flexible member end condition (30) of the resiliently flexible member end (10) can be sufficient to return the generally rectangular member (27) to the first fastener element retractor position as to certain embodiments of the inventive fastener (1).

Again referring to FIGS. 8 and 9, as to those embodiments of the inventive fastener (1) in which the flexed resiliently flexible member end condition (30) does not return toward the first fastener element retractor position (16) to establish an unflexed resiliently flexible member end condition (31), a fastener element retractor return element (19) in the form of a spring element (32) can engage the closed end of the generally rectangular channel (28) and a spring keeper (33) coupled to the generally rectangular member (27) can retain engagement of the spring element (32) with the generally rectangular member (27). Travel of the generally rectangular member (27) toward the a second fastener element retractor position (17) can be resisted by the spring element (32) which can forcibly urge the rectangular member (27) toward the first fastener element retractor position (16).

Figure 3:
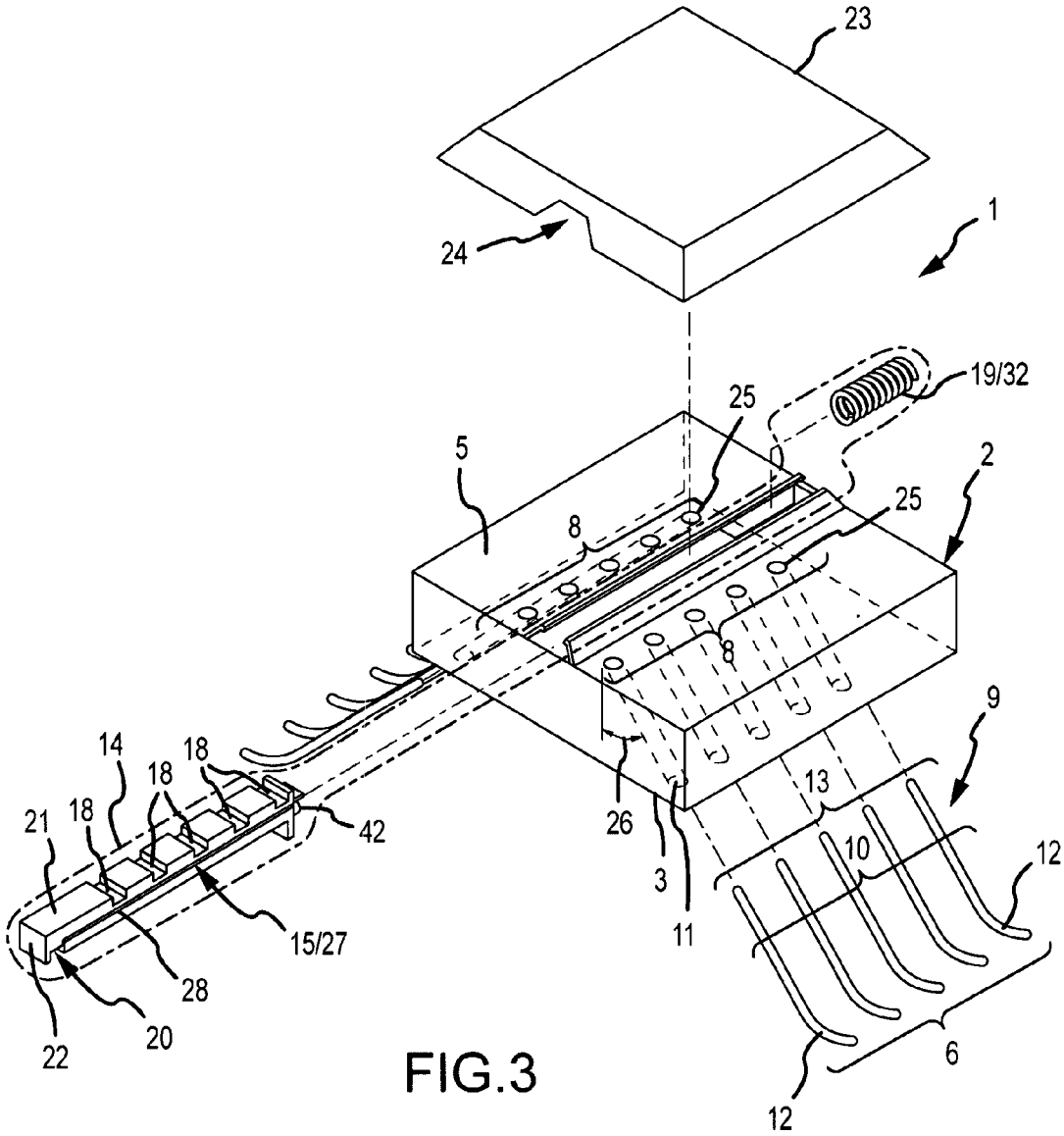
FIG. 3 is an exploded view of a particular embodiment of the inventive fastener.
Figure 4:
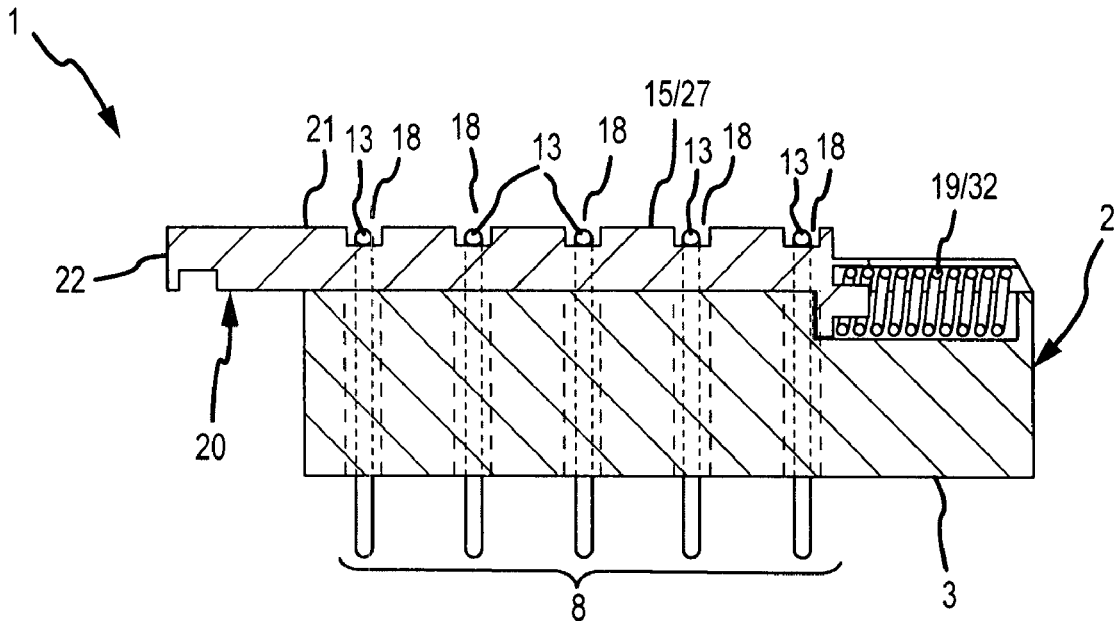
FIG. 4 is a cross section view of the particular embodiment of the inventive fastener shown in FIG. 5 with the fastener cover detached.
Figure 5:
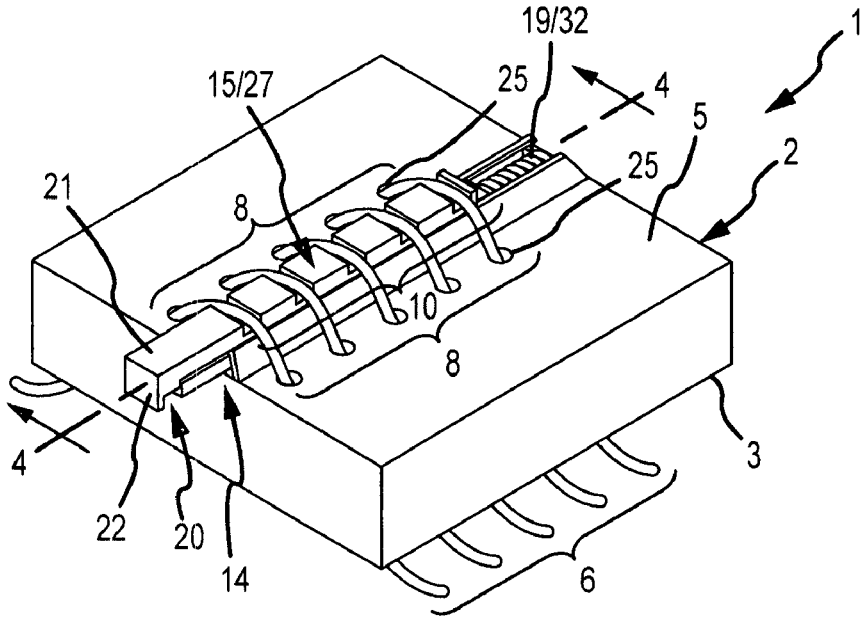
FIG. 5 is a perspective view of a particular embodiment of the inventive faster with the fastener cover detached.

As the embodiment of the inventive fastener (1) shown in FIGS. 1-12, the fastener element retractor travel generator (20) can comprise a pushable element (33) having a first travel generator end (21) coupled to the rectangular member (27) in a configuration which extends a distance outwardly along the longitudinal axis of the generally rectangular member (27) with a terminal pushable surface (34). As shown in FIG. 3, the pushable element (33) and the rectangular member can be provided as a single integral piece.

Now referring in particular to FIGS. 13-17, which shows another non-limiting embodiment of the inventive fastener (1), it can be understood that the fastener body (2) can provide a generally cylindrical configuration which provides a substantially circular planar first external surface (3) which as above described can be removably engaged to a fastenable material (4). A substantially circular second external surface (5) can be disposed in generally parallel planar opposed relation a distance apart defining a greater or lesser thickness of the fastener body (2) which can be for example between about one-sixteenth inch and about one quarter inch. The plurality of fastener member pathways (8) which communicate between the substantially circular planar first external surface (3) and the substantially circular second external surface (5) can be disposed radially about a cylindrical axis (35) of the cylindrical fastener body (2). Each one of the plurality of fastener member pathways (8) disposed radially about the cylindrical axis can communicate between the substantially circular planar first external surface (3) and the substantially circular second external surface (5) of the fastener body (2) at a fastener member pathway angle (26) (typically between about thirty and about sixty degrees from perpendicular to the substantially circular planar first external surface (3)) which assists in receiving each resiliently flexible fastener member end (13) of each resiliently flexible fastener member (10) into a corresponding one of the a plurality of fastener element retainers (18) of the fastener element retractor (15).

Each of the plurality of fastener elements (9) which slideably engage each of the corresponding plurality of fastener member pathways (8) disposed radially about the cylindrical axis (35) of the cylindrical fastener body (2) can be generated from a length of spring temper wire having a diameter of a circular of between about 0.003 inch and about 0.126 inch depending on the embodiment of the fastener (1). The fastener element retractor (15) can be configured as a conical member (36) rotationally mated to the cylindrical fastener body (2) at the cylindrical axis (35). The plurality of fastener element retainers (18) can comprise a plurality of radially extending slots (37) which are established between an apex (38) of the conical member (36) to a base (39) of the conical member (36) each of which receive a resiliently flexible fastener member end (13) of a resiliently flexible fastener member (10) slidely engaged in a corresponding one of the plurality of fastener member pathways (8). As shown in the Figures as to certain embodiments of the inventive fastener (1) the opposed ends of a pair of resiliently flexible fastener member ends (13) can be joined or produced as a single integral piece.

As shown in FIGS. 13 and 14, the conical member (36) can be rotated in a first direction from the first fastener element retractor position (16) toward the second fastener element retractor position (17) to deformably alter location of each resiliently flexible fastener member end (13) (or to generate a flexed resiliently flexible member end condition (30) of the resiliently flexible fastener member end (10)) which slides the resiliently flexible member (10) in each of the plurality of fastener member pathways (8) disposed radially about the cylindrical axis (35) to adjust location of each fastener hook (6). The flexed resiliently flexible member end condition (30) of the resiliently flexible member end (10) can be sufficient to reverse direction of rotation of the conical member (36) to return toward the first fastener element retractor position (16) as to certain embodiments of the inventive fastener (1).

As to those embodiments of the inventive fastener (1) shown in FIGS. 13-17 in which the flexed condition of the resiliently flexible member end (30) does not return toward the first fastener element retractor position (16) to establish an unflexed resiliently flexible member end condition (31), a fastener element retractor return element (19) in the form of a spring element (32) can be wound about the cylindrical axis (35) about which said conical member rotates having a first spring end (40) fixedly engaged to said conical member (36) and a second spring end (41) fixedly engaged to said cylindrical fastener body (2).

As the embodiment of the inventive fastener (1) shown in FIGS. 13-17, the fastener element retractor travel generator (21) can comprise a pushable element (33) coupled to the conical member (36) in a configuration which extends a distance outwardly from the conical member (36) to provide a terminal pushable surface (34).

As can be easily understood from the foregoing, the basic concepts of the present invention may be embodied in a variety of ways. The invention involves numerous and varied embodiments, including without limitation the best mode of an extendable retractable fastener.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "fastener" should be understood to encompass disclosure of the act of "fastening"—whether explicitly discussed or not—and, conversely, were there effectively disclosure of the act of "fastening", such a disclosure should be understood to encompass disclosure of a "fastener" and even a "means for fastening." Such alternative terms for each element or step are to be understood to be explicitly included in the description.

In addition, as to each term used it should be understood that unless its utilization in this application is inconsistent with such interpretation, common dictionary definitions should be understood to included in the description for each term as contained in the Random House Webster's Unabridged Dictionary, second edition, each definition hereby incorporated by reference.

Thus, the applicant(s) should be understood to claim at least: i) a fastener as herein disclosed and described, ii) the related methods of fastening disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth below are intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

I claim:

1. A fastener, comprising:

a) a fastener body having a first external surface configured to removably engage a fastenable material and a second external surface disposed in generally opposed relation a distance apart;

b) a plurality of fastener member pathways which communicate between said first external surface and said second external surface of said fastener body;

c) a plurality of fastener elements each one providing:

i) a resiliently flexible fastener member which slidely engages a corresponding one of said plurality of fastener member pathways, wherein said resiliently flexible fastener member terminates in a fastener member end; and ii) a fastener hook joined to said fastener member slidely engaged in said corresponding one of said plurality of fastener member pathways, wherein said fastener hook provides a configuration which allows hooked engagement of said fastenable material between said fastener hook and said first external surface of said fastener body; and d) a fastener element retractor assembly coupled to said fastener body which provides a fastener element retractor which operably mates with said fastener body to allow travel of said fastener element retractor between a first fastener element retractor position and a second fastener element retractor position, and wherein said fastener element retractor further provides a plurality of fastener element retainers each of which correspondingly receive one of said resiliently flexible fastener member ends, and wherein each of said plurality of fastener element retainers has a configuration which upon travel of said fastener element retractor from said first fastener element retractor position toward said second fastener element retractor position generates a flexed condition of said resiliently flexible fastener member end to adjust location of said fastener hook.

2. The fastener of claim 1, further comprising a fastener element retractor return element coupled between said fastener body and said fastener element retractor which forcibly urges said fastener element retractor from said second fastener element retractor position toward said first fastener element retractor position.

3. The fastener of claim 2, further comprising a fastener element retractor travel generator slidely mated with said fastener body, wherein said fastener element retractor travel generator provides a first travel generator end coupled to said fastener element retractor body and a second travel generator end which extends a distance outwardly from said fastener body, and wherein slideable operation of said fastener element retractor travel generator forcible urges said fastener element retractor to travel from said first fastener element retractor position toward said second fastener element retractor position.

4. The fastener of claim 3, further comprising a fastener cover which joins said fastener base to enclose said fastener element retractor assembly.

5. The fastener of claim 4, wherein said fastener body has a generally rectangular configuration having a first external surface which removably engages a fastenable material and a second external surface disposed in generally parallel planar opposed relation a distance apart, and wherein said plurality of fastener member pathways which communicate between said first external surface and said second external surface of said fastener body are disposed in a pair of substantially parallel rows a distance apart, and wherein said fastener element retractor comprises an generally rectangular member slidely mated in a generally rectangular channel of said fastener body having a location between said pair of substantially parallel rows of said plurality of fastener member pathways, and wherein said plurality of fastener element retainers comprises a plurality of slots each disposed generally perpendicular to the longitudinal axis of said fastener element retractor each of which receive one said resiliently flexible fastener member slidely engaged in a corresponding said fastener member pathway.

6. The fastener of claim 5, wherein said fastener element retractor return element comprises a spring element which engages a closed end of said generally rectangular channel and a spring keeper coupled to said generally rectangular member.

7. The fastener of claim 6, wherein said fastener element retractor travel generator comprises a pushable element which extends a distance outwardly along the longitudinal axis of said fastener element retractor.

8. The fastener of claim 4, wherein said fastener body comprises a cylindrical fastener body having a first external surface which removably engages a fastenable material and a second external surface disposed in a generally parallel planar opposed relation a distance apart, and wherein said plurality of fastener member pathways which communicate between said first external surface and said second external surface of said fastener body are disposed radially about a cylindrical axis of said cylindrical fastener body, and wherein said fastener element retractor comprises a conical member rotationally mated to said cylindrical fastener body at said cylindrical axis, and wherein said plurality of fastener element retainers comprises a plurality of slots which extend radially outward from an apex of said conical member to the base of said conical member each of which receive one said resiliently flexible fastener member slidely engaged in a corresponding said fastener member pathway.

9. The fastener of claim 8, wherein said fastener element retractor return element comprises a spring element wound about said cylindrical axis about which said conical member rotates having a first end fixedly engaged to said conical member and a second end fixedly engaged to said cylindrical body.

10. A method of generating a fastener, comprising the steps of:

a) providing a fastener body having a first external surface configured to removably engage a fastenable material and a second external surface disposed in generally opposed relation a distance apart;

b) establishing a plurality of fastener member pathways which communicate between said first external surface and said second external surface of said fastener body;

c) slidely engaging a resiliently flexible fastener member in each of said plurality of fastener member pathways;

d) joining a fastener hook to each said fastener member slidely engaged in each of said plurality of fastener member pathways said fastener hook configured to allow hooked engagement of said fastenable material; and e) coupling a fastener element retractor assembly to said fastener body further comprising the steps of:

i) mating a fastener element retractor with said fastener body which allows travel of said fastener element retractor between a first fastener element retractor position and a second fastener element retractor position; and ii) providing a plurality of fastener element retainers each of which correspondingly receive one of said resiliently flexible fastener member ends each of said plurality of fastener element retainers having a configuration which upon travel of said fastener element retractor from said first fastener element retractor position toward said second fastener element retractor position generates a flexed condition of said resiliently flexible fastener member end to adjust location of said fastener hook.

11. The method of generating a fastener of claim 10, further comprising the step of coupling a fastener element retractor return element between said fastener body and said fastener element retractor which forcibly urges said fastener element retractor from said second fastener element retractor position toward said first fastener element retractor position.

12. The method of generating a fastener of claim 10, further comprising the step of slidely mating a fastener element retractor travel generator with said fastener body, wherein said fastener element retractor travel generator provides a first travel generator end coupled to said fastener element retractor body and a second travel generator end which extends a distance outwardly from said fastener body, and wherein slideable operation of said fastener element retractor travel generator forcible urges said fastener element retractor to travel from said first fastener element retractor position toward said second fastener element retractor position.

13. The method of generating a fastener of claim 12, further comprising the step of joining a fastener cover to said fastener base to enclose said fastener element retractor assembly.

14. A method of fastening a fastener to a fastenable material, comprising the steps of:

a) engaging a fastener body having first a first external surface and a second external surface to said fastenable material, said fasterner body having a plurality of fastener member pathways which communicated between said first external surface and said second extern surface;

b) generating travel in a fastener element retractor operably mated with said fastener body from a second fastener element retractor position toward a first fastener element retractor position;

c) altering flexure in a plurality of resiliently flexible member ends in response to travel of said fastener element retractor from said second fastener retractor position toward said first fastener element retractor position from a flexed condition to an unflexed condition;

d) sliding a plurality of resiliently flexible members in a corresponding plurality of fastener member pathways in response to altering flexure in said plurality of flexible member ends;

e) adjusting location of a plurality of fastener hooks one each joined to a corresponding one each of said plurality of resiliently flexible members to extend beyond said first external surface of said fastener body; and f) fastening said plurality of fastener hooks which extend beyond said first external surface of said fasterner body to said fastenable material.

* * * * *